United States Patent [19]

Ibsen

[11] 4,253,523

[45] Mar. 3, 1981

[54] METHOD AND APPARATUS FOR WELL PERFORATION AND FRACTURING OPERATIONS

[76] Inventor: Barrie G. Ibsen, 14 2nd Ave. SW., P.O. Box 277, Cut Bank, Mont. 59427

[21] Appl. No.: 23,657

[22] Filed: Mar. 26, 1979

[51] Int. Cl.[3] ..... E21B 43/117; E21B 43/263; E21B 43/27

[52] U.S. Cl. ..... 166/299; 102/24 HC; 166/297; 166/307; 166/308; 175/4.6

[58] Field of Search ..... 166/299, 307, 308, 297; 175/4.6; 102/24 HC, 20

[56] References Cited

U.S. PATENT DOCUMENTS

| | | | |
|---|---|---|---|
| 2,766,828 | 10/1956 | Rachford, Jr. | 102/20 |
| 3,040,659 | 6/1962 | McCullough | 102/20 |
| 3,207,072 | 9/1965 | Holden | 102/24 HC |
| 3,215,074 | 11/1965 | Robinson, Jr. et al. | 175/4.6 X |
| 3,234,875 | 2/1966 | Tolson | 102/24 HC |
| 3,238,872 | 3/1966 | Zernow et al. | 102/20 |
| 3,244,101 | 4/1966 | Bell | 102/20 |
| 3,259,064 | 7/1966 | Owens | 102/24 HC |
| 3,268,016 | 8/1966 | Bell | 175/4.51 |
| 3,276,369 | 10/1966 | Bell | 175/4.6 X |
| 3,302,567 | 2/1967 | Venghiattis | 102/24 HC |
| 3,419,070 | 12/1968 | Ernst | 166/297 X |
| 3,517,745 | 6/1970 | Suman, Jr. | 166/297 |
| 3,627,045 | 12/1971 | Lebourg | 166/307 X |
| 3,650,212 | 3/1972 | Bauer | 102/20 |

*Primary Examiner*—Stephen J. Novosad
*Attorney, Agent, or Firm*—John E. Reilly

[57] ABSTRACT

A method and apparatus for well perforations and fracturing operations includes a shaped charge having a generally spherical container, a conical liner positioned therein, an explosive substantially filling the container around the liner, and a booster charge in the form of an annular wafer of compressed high speed explosive positioned against the wall of the container in axial alignment with and adjacent the apex of the liner. The outside diameter of the booster charge is at least as large as one-half the diameter of the base of the conical liner and in proximity to a primer cord positioned in contact with the exterior of the container. The spherical container is composed of a frangible material, and it is positioned in a cylindrical carrier also composed of a frangible material which disintegrates upon detonation of the explosive. A secondary explosive of slower detonating speed than the primary explosive is packed around the shaped charge container in the carrier, and the carrier is sealed at both ends.

32 Claims, 23 Drawing Figures

METHOD AND APPARATUS FOR WELL PERFORATION AND FRACTURING OPERATIONS

BACKGROUND OF THE INVENTION

Perforating into the rock matrix around a well bore is accomplished primarily by either shooting a bullet projectile into the rock matrix or detonating a shaped charge directed into the rock matrix, the latter being the most prevalent practice in perforating in recent times. While perforating wells by detonation of shaped charges into the rock structure has been widely used, quite highly developed, and has enjoyed a relatively high success, there are still many problems associated with perforating by means of shaped charges that have not heretofore been solved. For example, a typical perforation from a state-of-the-art shaped charge is in the form of a slender, conically shaped penetration of constantly decreasing cross-sectional area into the rock structure. Since formation damage commonly occurs to some extent around a well bore from the well drilling fluids, it is necessary that the perforation penetrate a sufficient distance into the rock structure to reach through the damaged area around the well bore to allow fluids in the formation to flow into the well. The depth of penetration of conventional while being sufficient in most cases, is not particularly great, and the shape of the conventional penetration is conical with a constantly decreasing diameter; therefore, it is usually only the extreme tip or distal end portion of the perforation where the diameter and cross-sectional area are very small that pentrates through the damaged portion of the rock into previously undisturbed formation structure. Consequently, the effective cross-sectional area of perforation through which well fluids can flow into the well is quite small.

Another problem caused by the shaped charge perforating itself is that the pressure and heat resulting from the penetration of the blast into the rock structure causes some fusion of the rock structure to occur resulting in an impervious shell immediately around the perforation. Consequently, even where the perforation reaches beyond the range of formation damage caused by invading well drilling fluids, the perforation process itself causes an impervious zone around each perforation for substantially its entire length, again leaving a relatively small effective cross-sectional area of conduit through which fluids can flow into the well. After a well has produced for a period of time, deposits of solid materials build up within the pores and flow conduit structures in the formation around the perforations and well bore. These deposits are commonly known as "gyp" or calcium carbonate and some varieties of iron sulfide, and they impede the flow of fluids into the well from the formation.

In some kinds of formations, further stimulation of the wells can be effective, such as, by acid treatment, i.e., pumping an acid such as hydrochloric acid or sulphuric acid or a mixture of both into the well, or hydraulically fracturing the rock formation in the well. These stimulation operations are not always successful due to formation materials that react adversely to the carrier fluids used in the stimulations or due to inability to initiate a fracture in the rock matrix at pressures that can be withstood by the well tubing or casing.

SUMMARY OF THE INVENTION

Accordingly, it is an object of the present invention to provide a novel shaped charge device for perforating and stimulating wells that is capable of producing a large and deep perforation in a well that extends beyond the normal region around the well bore damaged by the invading drilling fluids in a reliable and highly effective manner.

It is also an object of the present invention to provide a shaped charge capable of producing a large, deep perforation and can penetrate beyond an area in the formation around a well bore in which deposits of solid materials normally build up over periods of time during which a well has been producing.

It is also an object of the present invention to provide a shaped charge which is capable of perforating the formation around a well bore with an elongated penetration of substantially constant cross-sectional area along a substantial portion of its length.

It is also an object of the present invention to provide a novel perforating method and apparatus for producing a perforation which penetrates into the formation with fractures in the formation radiating outwardly from the sides and distal end of the perforation into the formation.

An additional object of the present invention is to provide perforating apparatus which is fabricated of a high density material with high tensile strength and compressive strength, yet which disintegrates into small particles upon detonation of the charge to avoid unnecessary obstructions and debris in the well.

It is a still further object of this invention to provide perforating apparatus of all expendible components manufactured from a corrosion resistant and heat resistant material which upon detonation of the charge disintegrates into small particles that are readily susceptible to reaction with a variety of acids commonly used in well stimulations.

It is still a further object of the present invention to provide a shaped charge and carrier assembly for perforating wells that is relatively inexpensive to manufacture, easy to assemble yet tough and resistant to impact.

The perforating and fracturing method and apparatus of the present invention includes a shaped charge device having a generally spherical container, a conical metallic liner in the container, a primary explosive in the container around the liner and a booster charge in the shape of an annular wafer of high detonating speed explosive. The annular booster charge is positioned in the container against the wall diametrically opposite the base of the liner and in axial alignment with the liner adjacent the liner apex. The outside diameter of the booster charge is at least as large as one-half the diameter of the base of the liner.

The perforating apparatus also includes a carrier in the form of an elongated cylindrical tube, and the shaped charges are positioned in the carrier. The interior peripheral surface of the carrier has a flattened portion on diametrically opposite sides thereof, and the the spherical container of the shaped charge has correspondingly flattened portions on diametrically opposite sides which match the flattened portions in the cylindrical carrier, and the corresponding flat sides retain the shaped charge in position in the carrier. The flat portions in the carrier and the spherical container are also provided with longitudinal grooves which when positioned together form a channel to accommodate a primer cord positioned against the spherical container of the shaped charge just outside the container wall from the booster charge. The flattened portion on the opposite side of the container from the primer cord is a circular plug positioned in an opening of equal size in the container and across the base of the liner.

The space in the carrier between the shaped charges positioned therein can be filled with a non-explosive material as a spacer to hold the shaped charges in position for normal perforating operations, or the space can be filled with a secondary explosive when it is desired to fracture the formation around the perforations. For this latter purpose, it is preferable that the secondary explosive in the carrier be of a slower detonating speed than the primary explosive in the shaped charge, and it is desirable to pack the secondary explosive in plastic bags in the carrier between the shaped charges.

In use, the carrier and shaped charge perforating assembly is positioned in the well at the depth desired to be perforated. The primer cord is detonated by either a blasting cap or an explosive bomb on a time fuse, and the primer cord in turn detonates the booster charge in the shaped charge. Initially, the size and position of the booster charge in axial alignment with the metallic liner causes the primary explosive in the shaped charge in the immediate vicinity around the liner to detonate. This first detonation shock energy causes the metallic liner to invert and project outwardly along its axis through the well casing and into the formation. This initial primary explosive shock is followed by a secondary shock wave of energy from explosion of the remaining primary explosive in the spherical container, which secondary shock wave follows the inverted metallic liner and maintains the inverted conical metallic shape of the liner in open or flared configuration for a substantial distance into the formation, thereby resulting in a perforation of substantially constant cross-sectional area for a substantial distance into the formation. As the energy from the explosion decreases and approaches the compressive strength of the formation rock matrix, the shape of the blast jet will deteriorate until the projectile stops resulting in a conical shape of rapidly decreasing diameter at the distal end of the perforation. Then, if the carrier is packed with a secondary explosive of slower detonating speed between the shaped charges, the shock wave of that secondary explosive will follow the initial jet into the perforated hole and will continue through the constant diameter perforated cavity exerting equal pressures around the internal peripheral surface of the cavity, and upon reaching the conical point of initial jet charged deterioration at the distal end of the cavity, all of the forces exerted by the secondary explosion will be concentrated on the tip of the conical cavity of decreasing diameter at the distal extremity thereof and will cause fracturing of the rock formation matrix primarily at this distal point, although some fracturing will also occur along the entire length of the perforated cavity. This fracturing is a useful step in well stimulating by acid treatment and hydraulic fracturing. The shaped charge container and the carrier are preferably made of a frangible material that disintegrates or shatters upon detonation into small pieces that react with acids commonly used in well stimulation operations.

DETAILED DESCRIPTION OF THE PREFERRED EMBODIMENT

Figure 1:
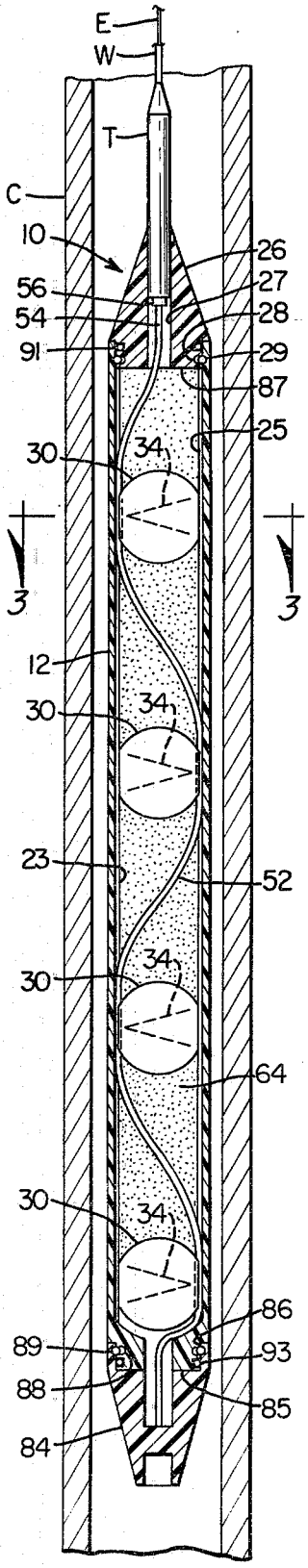
FIG. 1 is a cross-sectional view of the perforating assembly of the present invention positioned in the casing of a well.

The perforating gun assembly 10 of the present invention is shown in FIG. 1 suspended in the casing C of a well by a conventional wireline W and wireline tool head T. The perforating gun assembly 10 is comprised of a plurality of shaped charges 30 positioned in spaced-apart relationship to each other in an elongated cylindrical carrier 12 which is sealed at the top and bottom by covers 26, 84, respectively.

Figure 3:
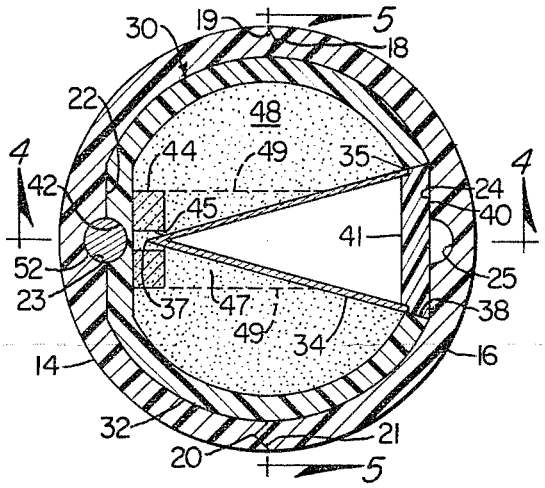
FIG. 3 is a cross-sectional view of the shaped charge and carrier of the present invention taken along lines 3—3 of FIG. 1.
Figure 4:
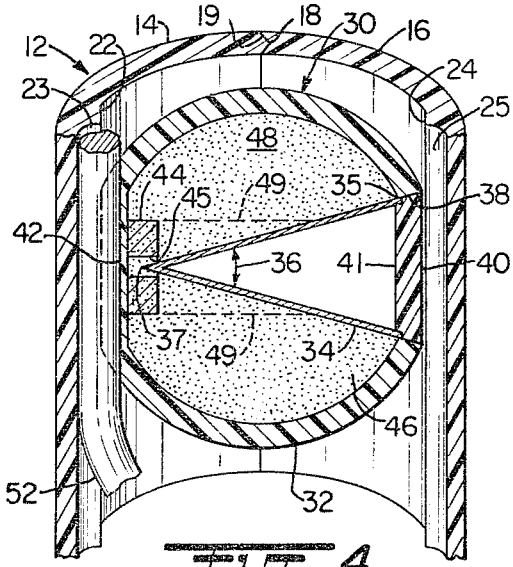
FIG. 4 is a cross-sectional view of the shaped charge and carrier of the present invention taken along lines 4—4 of FIG. 3.
Figure 5:
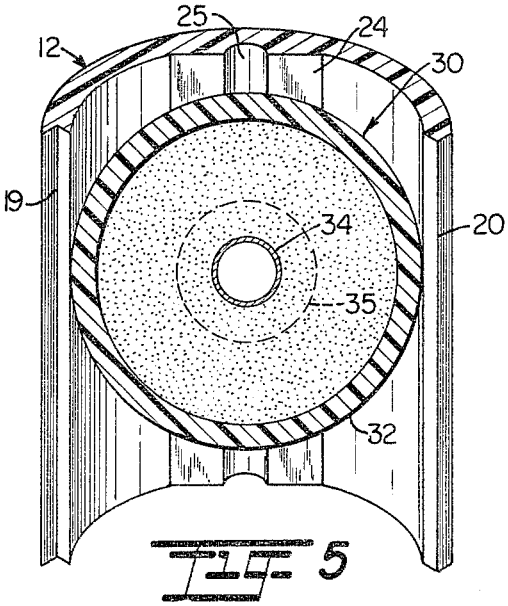
FIG. 5 is a cross-sectional view of the shaped charge and carrier of the present invention taken along lines 5—5 of FIG. 3.
Figure 7:
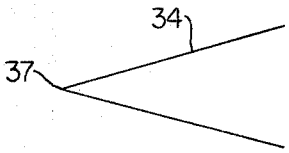
FIGS. 7 through 13 show a diagrammetric progression illustrating the inversion of the conical liner of the shaped charge in response to the explosive force of primary explosive around the liner in the the shaped charge.
Figure 8:
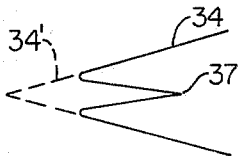
Figure 9:
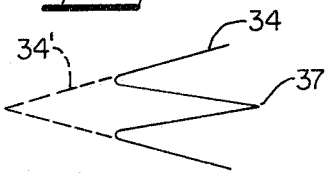
Figure 10:
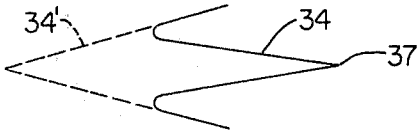
Figure 11:
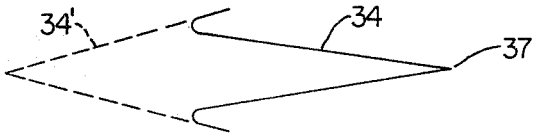
Figure 12:
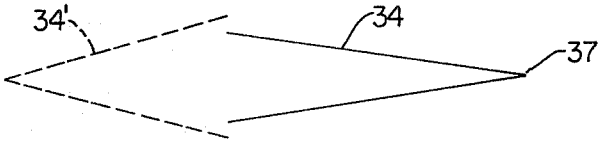
Figure 13:
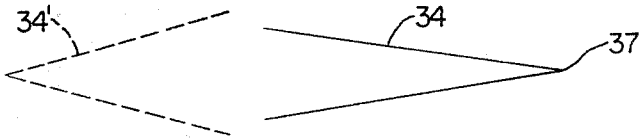

The shaped charge 30 is best seen in FIGS. 3 through 5, and includes a generally spherical shell or container 32 with a conical liner 34 positioned therein and extending diametrically across the interior of the spherical container 32 with its base end 35 positioned against one side of the container 32 and its apex 37 positioned adjacent the diametrically opposite side of the container 32. A plug 40 is positioned in the base of the liner 34 and sealed against the peripheral surface 38 of a circular opening in the wall of the spherical container 32. The outside surface of the plug 40 is flat, and the diametrically opposite side of the spherical container 32 is also flattened at a portion thereof having a size approximately equal to the size of the plug 40.

A booster charge 44 in the shape of an annular wafer of compressed high detonating speed explosive is positioned against the flat wall portion in the interior of the spherical container 32 in axial alignment with the conical liner 34 and with the apex 37 of the liner 34 positioned in the central hole 45 in the booster charge 44. The outside diameter of the booster charge 44 is preferably more than one-half the diameter of the base of the cone, but less than or equal to the full diameter of the base of the cone. A primary explosive 46 fills the interior of the spherical container 32 around the conical liner 34 and booster charge 44.

Also, as best seen in FIGS. 3 through 5, the carrier 12 is preferably formed in two halves 14, 16. The carrier half 14 has a rib 18 along one edge and groove 21 along its opposite edge, and the other carrier half 16 has a similar rib 20 and groove 19 along its respective edges, which grooves and ribs are adapted for mating and sealing together to form the cylindrical carrier 12. The interior peripheral surface of the carrier 12 has two flattened portions 22, 24, on diametrically opposite sides thereof and extending the full longitudinal length of the carrier 12. The flat portions 22, 24 are the same width as the diameter of the flattened portions of the spherical container 32 and are adapted to mate therewith to prevent the spherical container 32 from rotating in relation to the carrier 12.

The carrier 12 also has longitudinally extending channels 23, 25 extending the length of the carrier along the flat portions 22, 24, respectively. Each spherical container 32 also has a channel 42 in the flat portion which corresponds in size and position with the channel 23 in the carrier and adapted to accommodate the primer cord 52 therein. As best seen in FIGS. 1, 3, and 4, the primer cord 52 extends from the top cover 26 of the carrier 12 downwardly through the channels 23, 42 in the carrier 12 and container 32. As such, the primer cord 52 is positioned in close proximity to the booster charge 44 with only a thin portion of the carrier 32 separating the primer cord 52 from the booster charge 44.

The space in the carrier 12 between the shaped charges 30 is filled with a spacer material 64 to keep the shaped charges in the desired spaced-apart relation to each other in the carrier 12. The upper end 54 of the primer cord 52 extends upwardly through a bore 27 in the cover 26 into contact with an electric blasting cap 56 positioned in the lower end of the wireline tool T. The blasting cap 56 is connected to an electric potential source by electrical conductor E which is conventional in state-of-the-art wirelines in common usage.

The top cover 26 has a protrusion 87 of of reduced diameter extending downwardly into the interior of the carrier 12 a short distance. An annular groove 28 around the peripheral surface of the protrusion 87 can accommodate a snap ring fastener 29 for engaging the cover 26 with the carrier 12, and an O-ring seal 91 also positioned around the protrusion 87 of the cover 26 can help to seal the carrier. The bottom cover 84 can be similarly attached to the carrier by a snap ring fastener 89 positioned in an annular groove 88 around the peripheral surface of a downwardly protruding extension 85 of the carrier 12 into a similarly sized bore 86 in the bottom cover 84. An O-ring seal 93 can also seal around the extension 85 to the interior of the carrier from the exterior. Also, if desired, a number of carriers can be attached together by locking the downwardly protruding extension 85 of one carrier into the top of another carrier 12 utilizing the same snap ring fasteners and O-ring seals. It has also been found that when the carrier 12 and covers 26, 84 are fabricated of some kinds of materials, such as thermoplastics, the covers 26, 84 can be adhesively bonded to the carrier 12 with good results, thereby eliminating the need for the snap ring fasteners 29, 89 and O-ring seals 91, 93.

In operation, the perforating gun assembly 10 is positioned in the casing C at the depth desired to be perforated by a conventional wire line W and tool head T attached to the top cover 26 of the carrier 12. Then, by activation of conventional electrical controls in the wire line unit on a surface of the ground, the electric blasting cap 56 is detonated, which detonates the primer cord 52. The primer cord in turn detonates the booster charge 44 in the shaped charge 30. The high detonating speed of the explosive of the booster charge 44 is directed initially and most immediately along the axis of the cone and causes immediate detonation of the primary explosive 46 in the zone 47 around the liner 34 as designated by the broken line 49. The initial explosive energy of the detonation of the inner zone 47 of the primary explosive 46 causes the liner 34 to liquify and invert projecting the apex thereof outwardly along the axis of the cone in the progression illustrated in FIGS. 7 through 13. This phenomenon of inversion of the conical liner and directing of the explosive force along the axes of the cone in a shaped charge is known as the "Munroe Principle".

Figure 23:
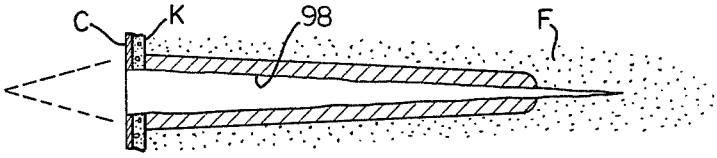
FIG. 23 illustrates the configuration of a conventional state-of-the-art perforation with decreasing cross-sectional area toward the distal end of the penetration.
Figure 15:
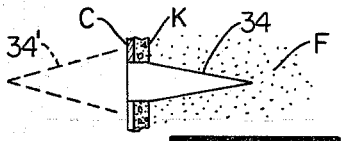
Figure 16:
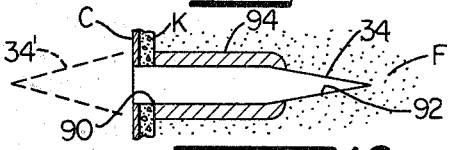
Figure 17:
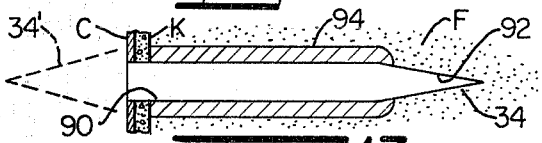
Figure 18:
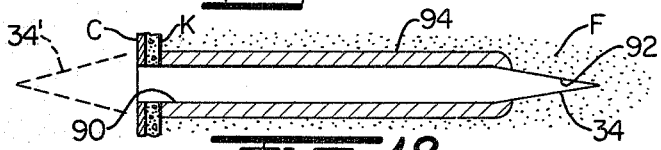
Figure 19:
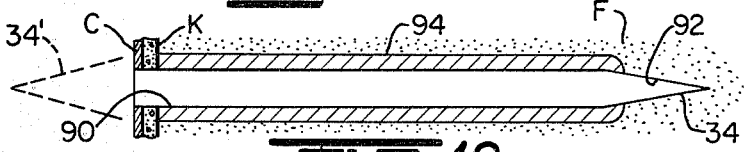
Figure 20:
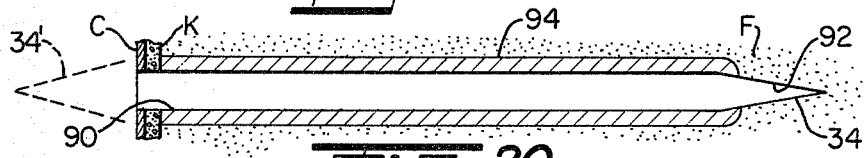
Figure 21:
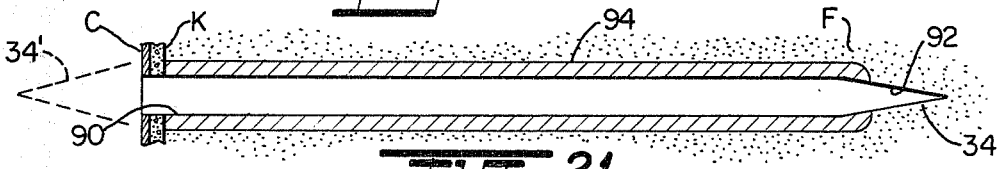
Figure 22:
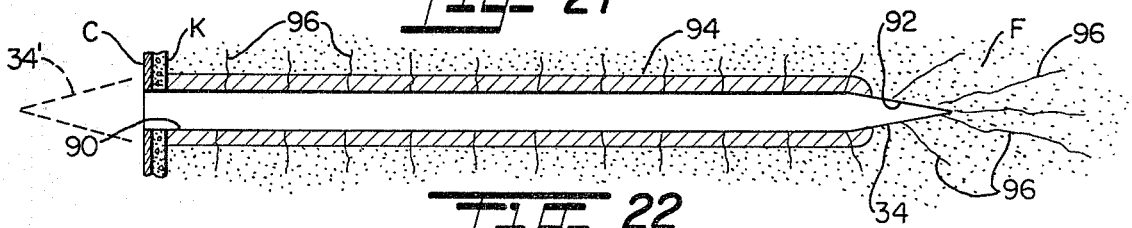
FIG. 22 illustrates the fracturing around the perforated cavity resulting from the secondary charge of the present invention.

Utilization of the Munroe Principle in shaped charge perforating is conventional and produces a penetration through the casing C of the well and cement K around the casing C and into the formation rock matrix F having a constantly decreasing cross-sectional area in the form of a conical cavity 98 as shown in FIG. 23. However, because of the position, size and shape of the booster charge 44 and the shaped charge 30 of the present invention, the initial explosion of the primary explosive in the first zone 47 is followed immediately by the explosive energy of the detonation of the primary explosive 46 in the second zone 48 outside the broken line 49. This followup explosive energy follows the inverted conical liner 34 into the formation and keeps it in an open or flared configuration, preventing it from collapsing, and thereby causes a perforation 90 of the formation having a substantial length of approximately constant diameter penetration as shown in the progression of stages in FIGS. 14 through 21, as opposed to the constantly decreasing cross-sectional area of the conventional perforation 98 shown in FIG. 23. As the energy of the penetrating force decreases to the compressive strength of the formation rock matrix F, the liner 34 rapidly collapses to leave a conically pointed end 92 at the distal end of the perforation.

It has been found that the diameter of the resulting perforation 90 in the formation F is approximately the same size as the diameter of the booster charge 44 used in the shaped charge 30. Therefore, the diameter of the booster charge 44 is important. Of course a perforation with as large a diameter as possible is desirable; however, the larger the diameter, the more energy is required to make the perforation. Therefore, it might not be possible to obtain a long perforation when the diameter is large. It has been found that a desirable balance of these criteria in relation to the size of the container 32 and the amount and strength of primary explosive 46 can be obtained by use of a booster charge 44 with a diameter more than half as large as the diameter of the base of the conical liner 34, but less than the full diameter of the base of the conical liner 34.

Since a substantial portion of the length of the perforation 90 has an approximately constant cross-sectional area rather than a decreasing cross-sectional area which extends through the zone normally damaged by well drilling fluids, the flow of the fluid into the well bore is significantly enhanced over the conventional shaped charge perforation 98 shown in FIG. 23. However, the nature of penetration of shaped charge perforating, with the resulting heat and compressive forces of the directed explosive energy into the formation F also causes a fusion of the formation rock matrix F immediately surrounding the perforation 90 as indicated at 94 in FIGS. 14 through 22. This fused zone 94 around the perforation 90 is substantially impervious to the flow of fluid and therefore inhibits the flow of fluid into the well.

Figure 2:
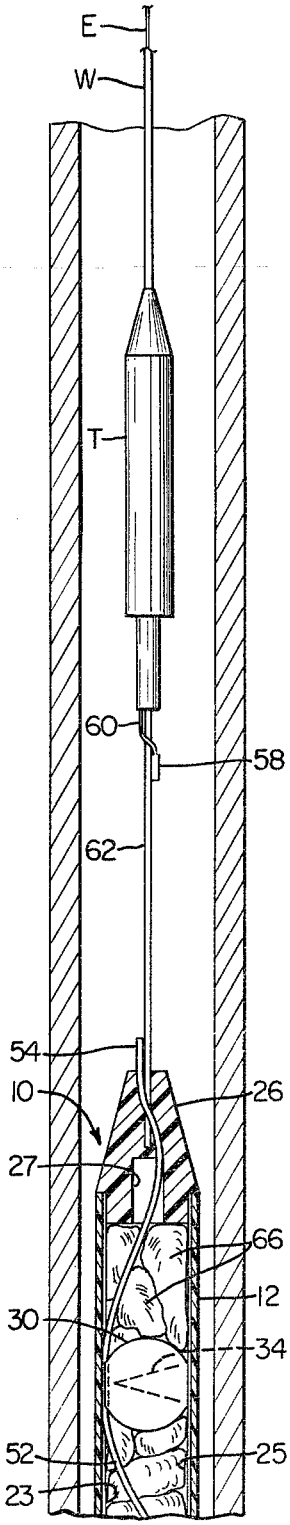
FIG. 2 is a cross-sectional view of the perforating and stimulating apparatus of the present invention positioned in the casing of a well, shown detachably connected to a wire line tool head with an aluminum rod.
Figure 6:
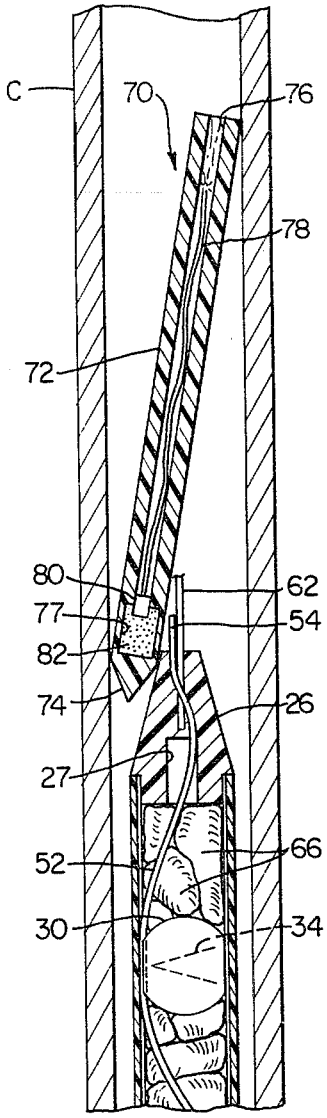
FIG. 6 is a cross-sectional view of the shaped charge and carrier assembly of FIG. 2 with the wire line tool head removed from the well and a detonater bomb with time fuse dropped into position adjacent the primer cord.
Figure 14:
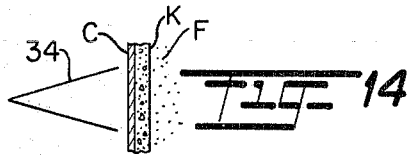
FIGS. 14 through 21 illustrate the progression of the perforation resulting from the explosive force of the present invention penetrating the formation rock matrix around the well bore.

Consequently, the present invention also includes an additional feature for alleviating the problems caused by the impervious zone 94 around the perforation 90. As best seen in FIGS. 2 and 6, the spaces in the carrier 12 between the shaped charges 30 are filled with a secondary explosive 66, rather than the non-explosive spacer material 64 shown in FIG. 1, and it is preferably packed in plastic bags as shown to seal it from air and moisture and for ease of handling. This secondary explosive 66 is also preferably of a slower detonating speed than the primary explosive 46 in the interior of the shaped charge spherical container 32. Detonation of the primer cord 52 in this embodiment detonates the primary explosive in a shaped charge 30 as described above in the preferred embodiment and also simultaneously detonates the secondary explosive 66. Consequently, the force of the primary explosive 46 of the shaped charge, which produces the constant diameter perforated cavity in the formation F, as described above, is followed by the force of the secondary explosive 66 which travels down the constant diameter cavity or perforation 90 exerting equal pressures around the internal walls of the cavity 90, and, upon reaching the point 92 of jet charged deterioration at the distal end of the perforation, all of the forces exerted by the secondary charge 66 are concentrated on the conical cavity of decreasing diameter 92 at the distal end of the cavity 90 causing fracturing 96 of the rock formation F at the point. Although the primary fracturing 96 occurs at the point at the distal end of the cavity 90, the force of the secondary explosive 66 also causes some fracturing 96 along the entire longitudinal surface of the cavity 90 when the forces reach the end of the cavity 92. Therefore, the addition of the secondary charge 66 in this invention not only fractures through the impervious layer 94 formed around the cavity 90 along its length, but it also causes substantial fracturing 96 extending from the distal end 92 of the perforation 90.

These fractures are beneficial for enhancing the flow of fluid from the formation F through the perforation 90 and into the well bore, and they are also beneficial as a pre-stimulating operation. For example, if an acid is pumped into the well, it will flow outwardly into the formation F through the fractures 96 and therefore penetrate farther into the formation resulting in a more far reaching zone of reaction with materials such as "gyp" or calcium carbonate and varieties of iron sulfide which commonly are deposited in the pores of the rock formation F around the well bore after the well has been produced for some period of time. Also, if it is desired to hydraulically fracture the formation, the fractures 96 caused by the perforating gun assembly of this invention with its secondary explosive feature provide effective initial fractures along which the hydraulic fracturing fluid can begin to penetrate and open the formation, thereby frequently contributing to the success of the hydraulic fracture operation by starting the fracturing of the formation within a pressure range capable of being withstood by the well casing, tubing, and other completion equipment.

FIGS. 2 and 6 also illustrate an alternative method of setting and detonating the charges in the perforating gun assembly 10 shown therein. As best seen in FIG. 2, the perforating gun assembly 10 is suspended from the wireline tool heat T at a substantial distance therefrom by an elongated, expandable aluminum rod 62. An electric blasting cap 58 is positioned on the side of the aluminum rod 62 near its upper end and connected to the electrical conducter E of the wireline by wire 60 in the conventional manner. After the perforating gun assembly 10 is lowered into the well to the desired depth and set at that depth such as on a pre-positioned bridge plug or on the bottom of the well, the blasting cap 58 is detonated shattering the aluminum rod 62. The wireline tool head T is then pulled out of the well, and a detonator bomb 70 is dropped into the well. The detonator bomb 70 is comprised of a cylindrical tube 72 with a tapered lower end 74 and an enlarged cavity 77 at its lower end filled with an explosive 82. A blasting cap 80 is positioned in contact with the explosive 82 and is connected to a timed fuse 78 extending upwardly through the bore 76 of the cylindrical tube 72. The fuse 78 is ignited at the top of the well before it is dropped, and the bomb 70 falls until it lodges adjacent the top cover 26 of the perforating gun assembly 10. The upper end 54 of the primer core 52 extends outwardly of the cover 26 and is detonated by the explosion of the detonating bomb 70. Upon detonation of the primer cord 52, the primary explosive 46 in the shaped charge 30 and the secondary explosive 66 in the carrier 12 are detonated simultaneously as described above.

The shaped charge container 32 and the carrier 12 of the present invention are preferably fabricated of a thermoplastic material such as polystyrene or vinyl mixed with calcium carbonate filler material which shatters into small pieces upon detonation of the explosives therein. The container 32 preferably includes 50% by weight calcium carbonate filler material in the polystyrene or vinyl, and the carrier assembly 12 includes 50% by weight of calcium carbonate filler material and a plasticizing agent for increased resilience. The calcium carbonate filler material is reactive with most of the common acids used in stimulating wells so that debris from the perforating gun will be dissolved during acid stimulating operations. It has also been found satisfactory to fabricate the carrier 12 and container 32 with a thermal setting epoxy material with calcium carbonate filler and a plasticizing agent in the carrier.

It is also preferred that the materials used to fabricate the carrier 12 and container 32 are of high density so any remaining debris after detonation will readily sink to the bottom of the well. For this purpose, the material should be at least 1½ times as dense as supersaturated salt water. The above described materials have a specific gravity of about 1.75, so they are satisfactory in this regard.

The conical liner 34 and the shaped charge 30 is preferably fabricated of copper with its sides diverging outwardly from its apex at an angle of approximately 16° from its longitudinal axis. The peripheral surface 38 of the opening in the container 32 and the corresponding peripheral surface of the plug 40 preferably diverge outwardly at an angle from the longitudinal axis of the liner somewhat larger than the angle of divergence of the liner 34, such as approximately 20°.

It is has been found that a primary explosive 46 in the form of a gel in the interior of the shaped charge container 32 having a detonating speed of about 19,900 feet per second with a PETN booster charge with a detonating speed of approximately 26,000 feet per second satisfactorily produces the constant diameter perforations described above. Also, it has been found that a secondary explosive 66 having a detonating speed of approximately 13,500 feet per second produces the desired fracturing of the formation around the perforation as described above. An RDX primer cord with a detonating speed of approximately 28,000 feet per second has been found satisfactory. It has also been found that a non-activated ammonium nitrate is satisfactory for use as a spacing material 64 between the shaped charges 30 of the preferred embodiment, and an activated ammonium nitrate secondary explosive 66 in the alternate embodiment.

Although the present invention has been described with a certain degree of particularity relative to the foregoing detailed description of the preferred embodiment, various modifications, changes additions and applications other than those specifically mentioned herein will be readily apparent to those having normal skill in the art without departing from the spirit and scope of this invention.

I claim:

1. A shaped charge device, comprising:

a generally spherical container with a hollow interior;

a conical liner with its base positioned against the interior surface of said spherical container and tapering inwardly to its apex positioned in close proximity to the diametrically opposite side of the interior surface of said spherical container;

an annular booster charge of high speed explosive with a diameter at least one-half as large as the base of said conical liner in axial alignment with said conical liner and against the interior wall of said spherical container diametrically opposite said base of said conical liner, the apex of said conical liner extending into the center of said annular booster charge; and a primary explosive charge positioned in the interior of said spherical container in sufficient quantity to substantially fill the remaining space therein around said conical liner and said booster charge.

2. The shaped charge device of claim 1, wherein said conical liner is of metallic copper about 0.032" thickness and has an angle between its axis and wall of about 16°, said spherical container is a frangible, thermoplastic material with about 50% by weight calcium carbonate filler material, the apex of said conical liner is positioned about 0.20" inward from said flat interior portion of said container wall, the thickness of the container wall between said channel and said booster charge is about 0.125", the peripheral surface of said opening is tapered inwardly at an angle of about 20° from the axis of the opening, the axis of said opening being aligned with the axis of said conical liner, the booster charge is a compressed wafer of PETN explosive with a speed of detonation of about 26,000 ft./sec., and the primary explosive in the primary explosive charge is an explosive gell with a speed of detonation of about 19,900 ft./sec.

3. Apparatus for simultaneously perforating and fracturing wells, comprising:

an elongated cylindrical carrier with a hollow interior;

at least one shaped charge positioned in said carrier, each charge including a generally spherical container with a hollow interior and an outside diameter substantially equal to the interior diameter of said carrier, a conical liner positioned in said spherical container with its base positioned adjacent the interior surface of the container wall on one side thereof and tapering inwardly to its apex positioned in close proximity to the interior diametrically opposite side of the container wall, a booster charge positioned in abutment against said interior diametrically opposite side of the container wall in axial alignment with said conical liner, and a primary explosive in the interior space of said container filling substantially all of said interior space around said conical liner and booster charge, the detonating speed of said primary explosive being less than the detonating speed of said booster charge;

a secondary explosive of slower detonating speed than said primary explosive positioned in the interior of said carrier over and under said shaped charge; and detonating means for simultaneously detonating said booster charge, primary explosive, and secondary explosive when the apparatus is positioned in the desired location in a well to be perforated and fractured.

4. The apparatus of claim 3, wherein said secondary explosive is sealed in a plurality of plastic bags placed over and under said shaped charge, and said detonating means includes a primer cord made of a high detonating speed explosive positioned in said carrier to pass through said secondary explosive and in contact with said shaped charge in close proximity to said booster charge.

5. Apparatus for perforating wells, comprising:

an elongated cylindrical carrier with a hollow interior and a cap on each end, the interior of said carrier being of substantially circular cross-sectional configuration with two flat portions on diametrically opposite sides from each other;

a shaped charge positioned in said carrier, including a generally spherical container with a hollow interior and an outside diameter substantially equal to the interior diameter of said carrier and with two flat portions on diametrically opposite sides of said spherical container, the diameters of said flat portions on the exterior of spherical container being approximately equal to the width of said flat portions on the interior of said carrier, said shaped charge being positioned in said carrier with said flat portions of said spherical container in abutting relation to the respective flat portions on the interior of said carrier, said shaped charge also including a a conical liner positioned therein with its base adjacent one of said flat portions in the wall of said spherical container and its apex in the proximity of the diametrically opposite flat portion of said container, a booster charge of high detonating speed explosive positioned adjacent said apex of said conical liner and abutting against said diametrically opposite flat portion of said container, and a primary explosive of slower detonating speed than said booster charge positioned in the interior space of said container around said liner and said booster charge;

a spacer material in the interior of said carrier above and below said shaped charge;

detonating means for detonating said booster charge and said primary explosive; and attachment means adapted for attaching said carrier to a wireline tool head.

6. The apparatus of claim 5, including a longitudinal channel in at least one of said flat portions in the interior surface of said carrier and a channel in the exterior surface of said diametrically opposite flat portion of said container in adjacent longitudinally aligned relation with said channel in said carrier, and a primer cord of high speed explosive positioned in said aligned channels.

7. The apparatus of claim 6, wherein said booster charge is a compressed annular wafer of high speed explosive with an outside diameter at least as large as one-half the diameter of the base of said conical liner, and the apex of said liner protrudes into the hole in said annular booster charge.

8. The apparatus of claim 6, including a spacer material in the interior of said carrier over and under said shaped charge.

9. The apparatus of claim 8, wherein said spacer material is non-activated ammonium nitrate.

10. The apparatus of claim 8, wherein said spacer material is a secondary explosive.

11. The apparatus of claim 10, wherein said secondary explosive is activated ammonium nitrate.

12. The apparatus of claim 11, wherein said secondary explosive is sealed in a plurality of plastic bags.

13. The apparatus of claim 6, wherein said carrier has a plurality of circular grooves around its interior surface near one end adapted for receiving a snap ring fastener and an O-ring seal, and the opposite end is closed and terminates in a protrusion having an outside diameter approximately equal to the inside diameter of the carrier and also having a plurality of circular grooves around the external peripheral surface of said protrusion of corresponding size and spacing to said grooves in said one end, whereby a plurality of said carriers are adapted to be fastened together in longitudinal relation to each other by inserting the protrusion of said opposite end into the opening in said one end and fastening with a snap ring fastener and sealing with an O-ring seal positioned in respective of said grooves.

14. The apparatus of claim 13, including a cover on said one end which has a protrusion of approximately equal outside diameter to the inside diameter of said carrier with a plurality of circular grooves therein of corresponding size and spacing to the grooves in said carrier, the protrusion of said cover being inserted into said one end of said carrier and fastened with a snap ring fastener and sealed with an O-ring seal.

15. The apparatus of claim 14, wherein said cover includes a bore therein adapted for receiving a wire line tool head with an electric blasting cap therein and said primer cord extending from said carrier into said bore in said cover in contact with said blasting cap.

16. The apparatus of claim 14, including an expandible aluminum hanger rod extending longitudinally outward from said cover and adapted for engagement with a wire line tool head a spaced distance above said cover, said primer cord extends through said cover to the exterior thereof, and an electric blasting cap attached to said aluminum rod a spaced distance away from said primer cord.

17. The apparatus of claim 13, wherein said carrier is comprised of two semi-cylindrical sections of substantially equal size, each of said sections having a longitudinal V-shaped rib along one lateral edge and a longitudinal inverted V-shaped groove along its opposite edge, said rib and groove being adapted to mate with the corresponding rib and groove in opposite edges of the other of said two sections, said two sections being adhered together with respective of said ribs and grooves mated together to form said cylindrical carrier.

18. The apparatus of claim 17, wherein said carrier, container, and cover are fabricated of a frangible thermoplastic material mixed with calcium carbonate filler material.

19. The apparatus of claim 18, wherein the thermoplastic material is a polystyrene.

20. The apparatus of claim 18, wherein the thermoplastic material is a vinyl.

21. The apparatus of claim 17, wherein said carrier, container, and cover are fabricated of a frangible thermosetting epoxy mixed with calcium carbonate filler material.

22. The apparatus of claim 18 or 21, wherein said carrier and container include 50% by weight calcium carbonate filler material, and said cover includes 25% by weight calcium carbonate filler material and a plasticizing agent for increased resilience.

23. The method of perforating and stimulating the rock formation in a well, comprising the steps of:

positioning a booster charge in the form of a compressed wafer of high detonating speed explosive in a shaped charge spherical container having therein a conical metallic liner extending diametrically across the interior of the container, a primary explosive of slower detonating speed than the booster charge around the liner in such a manner that the booster charge is placed against the wall of the container diametrically opposite and in axial alignment with the base of the conical liner and adjacent the apex of the liner with the diameter of the booster charge at least one-half as large as the diameter of the base of the liner;

positioning a secondary explosive of slower detonating speed than the detonating speed of the primary explosive around the shaped charge;

positioning the shaped charge with the booster therein in the well at the desired perforating depth; and detonating the primary and secondary explosives in the vicinity immediately around the metallic liner by detonating the booster charge causing an initial explosive shock wave on the metallic liner forcing it to invert and travel into the rock formation followed by detonating the primary explosive in the container farther removed from the liner causing a followup explosive shock wave immediately behind the inverted conical liner and keeping the liner from collapsing for a distance into the rock formation.

24. The method of claim 23, including the steps of positioning a primer cord of high speed explosive in contact with said container in proximity to said booster charge and in contact with said secondary explosive, connecting the primer cord to an electric blasting cap, and detonating said booster charge and primary explosive within the container and the secondary charge outside the container by detonating the blasting cap to detonate the primer cord, thereby causing the booster charge, primary explosive, and secondary explosive to detonate.

25. The method of claim 23, including the steps of positioning a primer cord of high speed explosive in contact with said container in proximity to said booster charge and in contact with said secondary explosive, and detonating said primer cord by dropping a bomb with an ignited timed fuse into the well with sufficient time on the fuse to allow the bomb to drop into the well to a position in proximity to the primer cord and explode there to detonate said primer cord.

26. The method of claim 25, wherein the shaped charge, secondary explosive, and primer cord are positioned in the well by placing them in a cylindrical carrier, sealing both ends of the carrier, attaching said carrier to a wire line tool head with an elongated aluminum rod, attaching an electric blasting cap to the aluminum rod, lowering the carrier into the well, detonating the blasting cap to sever the aluminum rod, and pulling the wire line tool head out of the well.

27. The method of perforating and stimulating the rock formation in a well, comprising the steps of:

packing a secondary explosive around a shaped charge of primary explosive in a shaped charge spherical container having a conical liner therein, said secondary explosive having a slower detonating speed than the detonating speed of the primary explosive;

positioning the shaped charge spherical container; primary and secondary explosives in the well at the desired perforating depth; and simultaneously detonating said primary and secondary explosives in said shaped charge spherical container.

28. The method of claim 27, including the step of pumping acid into the well.

29. The method of claim 27, including the step of pumping a viscous fluid and granular particles into the well.

30. A shaped charge device, comprising:

a generally spherical container with a hollow interior;

a conical liner with its base positioned against the interior surface of said spherical container and tapering inwardly to its apex positioned in close proximity to the diametrically opposite side of the interior surface of said spherical container, and wherein a portion of the interior surface of said spherical container in axial alignmwnt with said conical liner and adjacent the apex of said conical liner is flat;

an annular booster charge of high speed explosive in axial alignment with said conical liner and against the interior wall of said spherical container diametrically opposite said base of said conical liner, the diameter of said flat portion being at least as large as the diameter of said booster charge, said booster charge being positioned in abutting relation against said flat portion, and a portion of the wall of said spherical container at said flat portion being of decreased thickness in relation to the thickness of the remaining wall of said spherical container in close proximity to said booster charge; and a primary explosive charge positioned in the interior of said spherical container in sufficient quantity to substantially fill the remaining space therein around said conical liner and said booster charge.

31. The shaped charge device of claim 30, including a circular opening in the wall of said spherical container in axial alignment with said conical liner and adjacent to the base of said conical liner, the peripheral surface of said opening being tapered inwardly to an inner diameter approximately corresponding to the outer diameter of the base of said conical liner, and a circular plug securely positioned in said opening, said plug having flat inner and outer surfaces and an inwardly tapered peripheral surface of a size and shape corresponding to the size and shape of the peripheral surface of said opening in said spherical container, said flat outer surface being flush with the adjacent exterior surface of said spherical container.

32. The shaped charge device of claim 31, wherein a portion of the exterior surface of said spherical container diametrically opposite said opening and adjacent said flat interior portion is flat, and a channel of semicircular cross section is positioned in and extends across said flat exterior surface portion, said channel being sized and shaped to receive a primer cord therein and the portion of said wall between said channel and said flat interior surface being said wall portion of decreased thickness adjacent said booster charge.

* * * * *

UNITED STATES PATENT AND TRADEMARK OFFICE

CERTIFICATE OF CORRECTION

PATENT NO. : 4,253,523

DATED : March3, 1981

INVENTOR(S) : Barrie G. Ibsen

It is certified that error appears in the above—identified patent and that said Letters Patent is hereby corrected as shown below:

In The Specification:

Column 2, line 12, cancel "and" and substitute -- that --.

Column 2, line 61, cancel "the" (first occurrence).

Column 4, line 24, cancel "diagrammetric" and substitute -- diagrammatic --.

Column 5, line 47, after "of", cancel "of".

Column 7, line 63, cancel "been".

Column 8, line 10, cancel "heat" and substitute -- head --.

Column 9, line 24, after "changes" insert -- , --.

In The Claims:

Claim 5, Column 10, line 58, cancel "a".

Claim 30, Column 14, line 4, cancel "alignmwnt" and substitute -- alignment --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*